United States Patent [19]

Nagl et al.

[11] 4,402,273

[45] Sep. 6, 1983

[54] REDUCTION OF NITROGEN OXIDE EMISSIONS FROM CALCINERS

[75] Inventors: Gary J. Nagl, Hoffman Estates; Leslie C. Hardison, Barrington, both of Ill.

[73] Assignee: ARI Technologies, Inc., Palatine, Ill.

[21] Appl. No.: 353,198

[22] Filed: Mar. 1, 1982

[51] Int. Cl.[3] ..... F23G 5/00

[52] U.S. Cl. ..... 110/229; 110/230; 110/347; 432/14

[58] Field of Search ..... 110/229, 230, 244, 245, 110/263, 347; 432/14; 431/10

[56] References Cited

U.S. PATENT DOCUMENTS

| | | | |
|---|---|---|---|
| 4,186,665 | 2/1980 | Cowan et al. | 110/229 X |
| 4,193,773 | 3/1980 | Staudinger | 431/10 X |
| 4,253,409 | 3/1981 | Wormser | 110/229 X |
| 4,310,298 | 1/1982 | Abelitis | 432/14 |
| 4,326,471 | 4/1982 | Rohrbach et al. | 110/229 X |
| 4,329,932 | 5/1982 | Takahashi et al. | 110/347 X |

*Primary Examiner*—Edward G. Favors

*Attorney, Agent, or Firm*—Marriam, Marshall & Bicknell

[57] ABSTRACT

Reduction of nitrogen oxide emissions from thermal incinerators is accomplished in installations for calcining solid carbonaceous materials such as petroleum coke and anthracite coal. A hot effluent gas stream containing hydrocarbon vapors and entrained carbonaceous solid particles is removed from the calciner, and means are provided to effect preliminary combustion of the hydrocarbon vapors but not the carbonaceous solid particles in the gas stream using substantially the stoichiometric amount of combustion air. The resultant gas that is substantially free of hydrocarbons and oxygen is introduced into the thermal incinerator, and combustion of the carbonaceous solid particles is effected with additional combustion air.

10 Claims, 2 Drawing Figures

FIG. 1
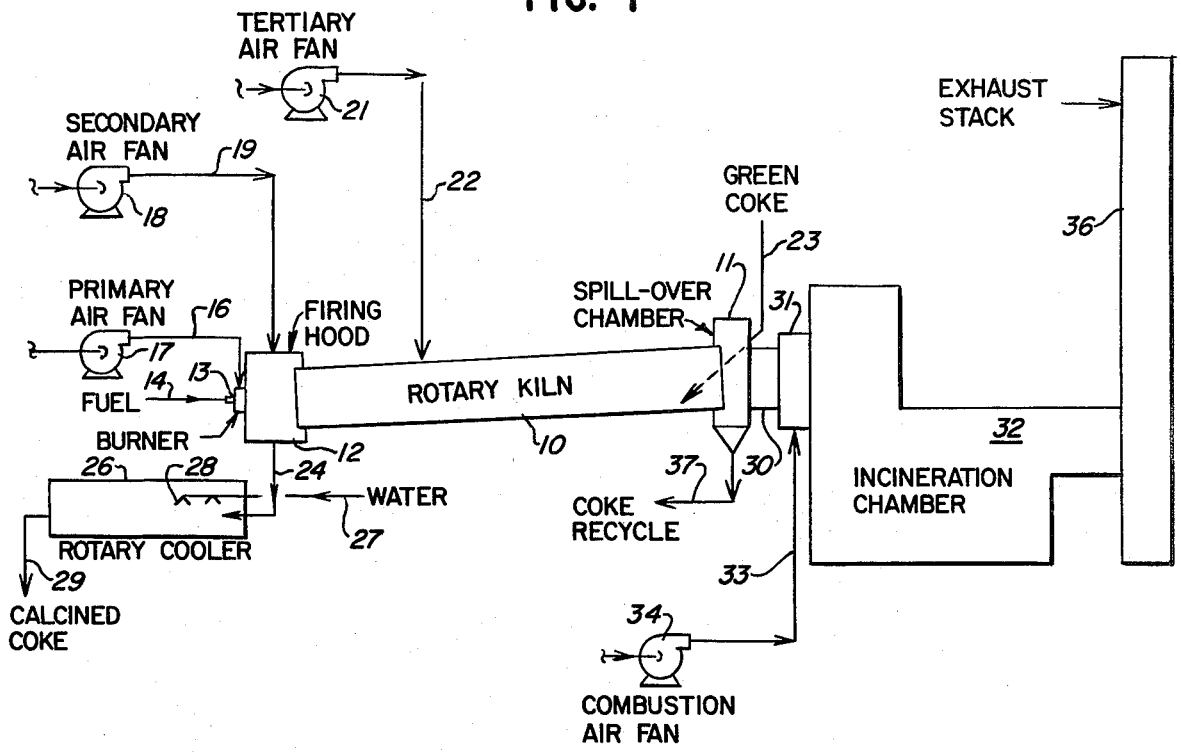
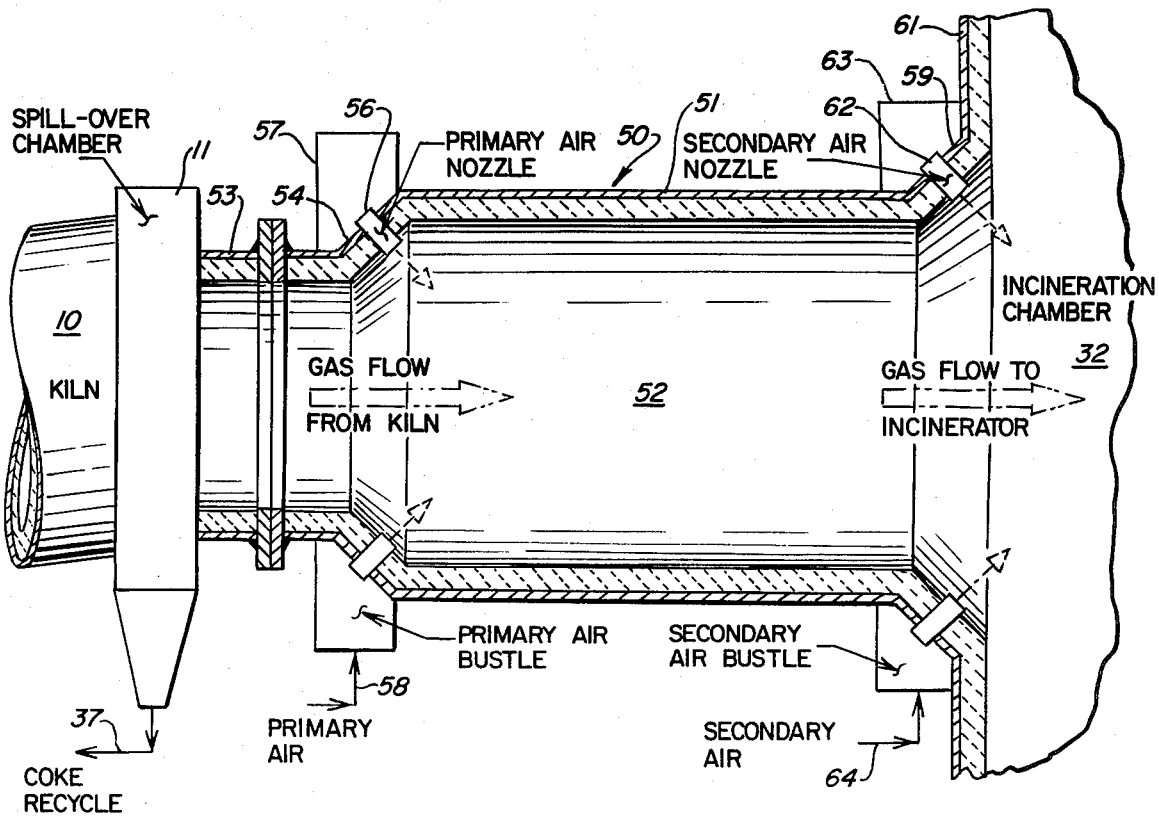
FIG. 2

REDUCTION OF NITROGEN OXIDE EMISSIONS FROM CALCINERS

This invention relates to a novel and improved method and apparatus for reducing the emissions of nitrogen oxides from incineration systems. More particularly, the invention relates to the reduction of nitrogen oxide emissions from thermal incinerators employed in installations for calcining solid carbonaceous materials such as petroleum coke and anthracite coal.

BACKGROUND OF THE INVENTION

Petroleum coke is a very pure form of carbon and is the principal raw material used in the manufacture of baked carbon products and graphite products. Anthracite coal is also used as a raw material for certain classes of carbon products. Both petroleum coke and anthracite coal are also widely used in the manufacture of electrodes for the aluminum industry. Petroleum coke and anthracite coal, however, have a substantial volatile content, e.g., 5–15% and typically about 10% in the case of petroleum coke. Calcination is therefore necessary before the coke or coal can be used as a raw material in the manufacture of baked carbon products and graphite products or for other purposes. Calcination is accomplished by heating the carbonaceous material in a rotary kiln calciner, a vertical shaft calciner or an electric calciner to a temperature on the order of 1200°–1800° C., dependent upon the intended end use of the product. Most petroleum coke is calcined in a rotary kiln, and in electrode manufacture the calcination temperature of the petroleum coke is typically about 1250° C. During the calcination step moisture, hydrocarbons, and other volatile components are removed and the density of the coke is increased.

The hot effluent gas from a rotary kiln calciner, contains hydrocarbon vapors and entrained carbonaceous solid or coke particles that cannot be discharged into the atmosphere under existing environmental restrictions. Instead, it is customary to mix the hot gas stream with combustion air in a thermal incinerator in order to effect combustion and removal of the hydrocarbon vapors and entrained carbonaceous solid or coke particles before the gas is discharged into the atmosphere. An additional pollution problem has been encountered, however, because the usual operating conditions in the thermal incinerator, including substantial excess oxygen and high combustion temperatures, are also conducive to the formation of oxides of nitrogen ($NO_x$). Oxides of nitrogen are regarded as a major contributor to air pollution in many localities, and current government regulations require reduced emissions of this pollutant from stationary industrial sources.

Attempts have been made to control nitrogen oxide emissions by regulation of the thermal incinerator, for example, by injecting combustion air at various locations in the incinerator in order to reduce the excess oxygen available for the formation of nitrogen oxides. These attempts have generally been unsuccessful or unreliable because of the difficulties involved in mixing and distributing cold combustion air in the hot gas stream being incinerated.

SUMMARY OF THE INVENTION

Accordingly, the broad object of the present invention is to provide a novel and improved method and apparatus for reducing the emissions of nitrogen oxides during incineration of gas streams containing combustible components.

A more specific object of the invention is to provide a novel and improved method and apparatus for reducing nitrogen oxide emissions from incineration systems employed in installations for calcining carbonaceous solids, particularly petroleum coke and anthracite coal.

In general, the foregoing objects are achieved by interposing a staged combustion zone between the rotary kiln calciner and the thermal incinerator, and by supplying to the inlet of said combustion zone substantially the stoichiometric amount of air required to effect combustion of only the hydrocarbon vapors contained in the gas and not the entrained carbonaceous solid or coke particles. Since the hydrocarbon vapors are easily oxidized in a short time as compared with the carbonaceous solid or coke particles, selective combustion of the hydrocarbons at high temperature is obtained in the staged combustion zone. The resultant gas to be introduced into the thermal incinerator, while still containing the entrained carbonaceous solid or coke particles, is essentially free of hydrocarbons and excess oxygen. The required additional combustion air is then added to and mixed with the gas at the outlet from the staged combustion zone so that combustion of the carbonaceous solid or coke particles is effected in the thermal incinerator at a lower temperature and a longer residence time. As a result of eliminating the detrimetnal combination of high temperatures and abundant excess oxygen, the $NO_x$ emissions from the incinerator are reduced significantly.

A more detailed description of the features and advantages of the invention is provided in connection with the accompanying drawings, wherein FIG. 1 is a schematic diagram of a conventional petroleum coke calcination apparatus; and FIG. 2 is an enlarged schematic view showing a modification of the apparatus of FIG. 1 in accordance with the present invention.

DETAILED DESCRIPTION

A typical prior art petroleum coke calcining operation employing an inclined rotary kiln is shown in FIG. 1. The kiln designated at 10 is connected at its upper elevated end to a spill-over chamber 11 and communicates at its lower end with a firing hood 12. A burner 13 is mounted in the hood 12 and has a fuel inlet line 14 and a primary air inlet line 16 connected to the outlet of a fan 17. Another fan 18 supplies secondary air through a line 19 to the hood 12. In some instances tertiary air is introduced by means of a fan 21 and line 22 to a plurality of ports (not shown) in the shell of the kiln 10.

The green petroleum coke in pulverized or subdivided form is fed into the elevated end of the rotary kiln 10, as indicated schematically by the line 23. The coke moves downwardly in the kiln 10 (to the left, as viewed in FIG. 1), and the hot combustion gases generated in the hood 12 and the kiln 10 move upwardly (to the right, as seen in FIG. 1) in countercurrent flow relationship to the coke. As the coke travels downwardly through the kiln, moisture and volatile hydrocarbons are removed from the coke, and the chemical structure of the coke is changed to produce the desired product quality. The gas stream emerging from the upper end of the rotary kiln 10 contains not only the moisture and hydrocarbon vapors removed from the coke but also significant quantities of entrained coke particles.

The hot calcined coke leaves the lower end of the kiln 10 and passes from the hood 12 thorugh a line 24 into a rotary cooler 26. Cooling water is introduced into the cooler 26 through a line 27 and spray nozzles 28, whereby the coke is cooled to approximately 300° F. (150° C.) by direct contact with water. The cooled calcined coke product is removed through a discharge line 29.

The hot effluent combustion gases emerge from the upper end of the kiln 10 and then pass through the spill-over chamber 11 and a short connecting passageway 30 into the bustle 31 of a thermal incineration chamber 32. Combustion air is supplied to the bustle 31 by means of a line 33 communicating with the outlet of a fan 34. In the incineration chamber 32 the hydrocarbon vapors and the entrained coke particles in the calciner effluent gas stream are completely burned, and the resultant gases are discharged to the atmosphere through a connecting exhaust stack 36. Any large pieces of coke that emerge from the upper end of the kiln 10 and are not entrained in the hot effluent gas stream are collected in the spill-over chamber 11 and withdrawn through a line 37 for recycle to the green coke supply source or otherwise recovered and used.

The requirements for the thermal incineration system of a petroleum coke calcining plant are more complex than the usual fume incinerator since the incineration system must perform the following functions:

(1) Oxidation of volatile hydrocarbons, (2 ) Retention of entrained large coke particles until the particle size is reduced by oxidation, and (3) Rapid oxidation of the small size coke particles.

These multiple functions are achieved in the conventional petroleum coke incineration system by utilizing high temperatures of above about 2000° F. (1095° C.), excess oxygen, and long residence times.

The volatile hydrocarbon components of the calciner effluent gas are rapidly oxidized (e.g., a residence time of about 0.5 seconds) provided that sufficient oxygen is available. The entrained coke particles in the gas stream, however, require a considerably greater residence time for complete combustion because of the oxygen diffusion limitations of the combustion reaction. To achieve the required performance of the incineration system, all of the combustion air is generally introduced through the bustle 31. This arrangement results in good mixing between the hot kiln effluent gas and the cold combustion air and produces a relatively hot flame because of the relative ease with which the volatile hydrocarbon materials are oxidized or burned as compared with the entrained coke particles. As a result, however, the combination of excess oxygen, high combustion temperatures, and long residence times in the incineration chamber 32 promotes the formation of nitrogen oxides.

In accordance with the present invention, a staged combustion zone is interposed between the hot effluent gas outlet from the kiln and the gas inlet to the incineration chamber, and by controlled introduction of air into this zone preliminary combustion of only the hydrocarbon content of the calciner effluent gas is effected without any significant oxidation or combustion of the entrained coke particles. More specifically, applicant's staged combustion zone is provided at the location designated by the passageway 30 in FIG. 1.

As shown in FIG. 2, applicant's staged combustion zone is provided by means of an elongated, horizontally disposed, refractory lined cylindrical or tubular vessel designated generally at 50. The main body portion 51 of the vessel has an enlarged diameter defining the combustion zone 52. An inlet portion 53 of reduced diameter is connected to the spill-over chamber 11 at the elevated end of the kiln 10, and the vessel portions 51 and 53 are integrally connected by a tapered portion 54. A plurality of primary air injection nozzles 56 are mounted in the tapered vessel portion 54, and the nozzles 56 are disposed at an angle so that the air streams are directed angularly inwardly and forwardly relative to the longitudinal axis of the vessel 50. A primary air bustle 57 is disposed annularly around the vessel so as to enclose the air nozzles 56. Primary combustion air is supplied to the bustle 57 through a line 58.

At the opposite end or outlet of the main body portion 51, the vessel 50 is provided with an outwardly tapered portion 59 and a vertically disposed flange or wall portion 61 that is attached to the inlet of the thermal incineration chamber 32. A plurality of secondary air injection nozzles 62 are mounted in the tapered portion 59 so that again the air streams from the nozzles are directed angularly inwardly and forwardly relative to the longitudinal axis of the vessel 50. An annular secondary air bustle 63 surrounds the air nozzles 62, and secondary air is supplied to the bustle 63 by means of a line 64.

The calciner effluent gas stream from the kiln 10 has a temperature of about 1600°–2200° F. (870°–1205° C.) and contains unburned hydrocarbon vapors and entrained coke particles, as previously described, and often a small amount of carbon monoxide. In addition, the gas stream is completely oxygen free. Immediately after passing through the reduced diameter inlet portion 53 of the vessel 50, the hot gas stream is commingled and intimately mixed with primary combustion air introduced through the nozzles 56. In accordance with the principle of the invention, the amount of primary combustion air injected at this location is limited to substantially the stoichiometric quantity of air required to oxidize all of the hydrocarbon material (and carbon monoxide, if present) in the calciner effluent gas to carbon dioxide and water. Accordingly, as the mixture of calciner effluent gas and primary combustion air passes through the combustion zone 52, the hydrocarbon content (and any carbon monoxide present) of the gas stream is preferentially oxidized or burned without any substantial oxidation of the entrained coke particles. This preferential oxidation is possible because the hydrocarbon materials (and carbon monoxide) are more readily combustible than the coke particles so that by restricting the residence time of the gas stream in the combustion zone 52, substantially complete combustion of the hydrocarbons (and carbon monoxide) is achieved without any substantial combustion of the entrained coke particles.

At a point downstream from the primary air nozzles 56, and after the hydrocarbons in the calciner effluent gas stream have been completely oxidized, secondary combustion air is injected into the gas stream through the nozzles 62 in order to supply the oxygen required for combustion of the entrained coke particles. As illustrated in FIG. 2, the preferred location for the injection of secondary combustion air is adjacent the outlet of the staged combustion vessel 50 as the gas stream enters the incineration chamber 32. In this manner, the secondary combustion air is commingled and intimately mixed with the gas stream before or during entry into the incinerator, thereby avoiding problems of stratification and inadequate mixing frequently encountered in the incinerator of a conventional system. The quantity of secondary combustion air injected through the nozzles 62 is controlled so as to insure complete combustion in the incinerator chamber 32 of the entrained coke particles in the gas stream. It will usually be desirable to provide sufficient secondary combustion air so that the oxygen available is slightly in excess of the stoichiometric quantity required for complete combustion of the coke particles.

The gas velocity through the staged combustion vessel 50 must be at least as high as the velocity of the effluent gas stream from the kiln 10 in order to prevent settling out of the entrained coke particles. Accordingly, the internal diameter of the vessel 50 is selected so as to insure the required gas velocity to prevent drop out of entrained coke particles. In addition, the length of the vessel 50 is selected to provide the required residence time in the zone 52 to obtain complete combustion of the hydrocarbon components of the gas. Since the hydrocarbons are more readily oxidized than the coke particles, a relatively short residence time in the zone 52 will suffice, e.g., from about 0.3 to about 0.7 seconds, and typically about 0.5 seconds. The combustion reaction for the entrained coke particles, however, proceeds much more slowly, and the incineration chamber 32 is therefore designed to provide a residence time much greater than the residence time in the staged combustion zone 52. For example, a residence time of at least about 12 seconds will ordinarily be required to insure combustion of the largest of the entrained coke particles.

The highest temperature obtained in the process is in the staged combustion zone 52 where the hydrocarbon materials are burned. However, by controlling the injection of primary air to the nozzles 56, excess oxygen is avoided during the time when the highest temperature prevails. In this manner, the formation of nitrogen oxide is repressed because of the absence of excess oxygen required for oxidation of nitrogen even though the kinetics and equilibria for $NO_x$ formation are favored by the high temperature. Since the combustion reaction for the entrained coke particles proceeds much more slowly, the initial heat release at the point of secondary air injection through the nozzles 62 is relatively low compared to that obtained upstream at the point of primary air injection through the nozzles 56. Consequently, even though a peak temperature of from about 2600° F. to about 3000° F. (1430°-1650° C.) may be obtained in the combustion zone 52, there will be an actual reduction in the gas temperature at the point where the gas is commingled with the secondary combustion air injected through the nozzles 62, and the peak temperature in the incineration chamber 32 will be at a lower level, e.g., from about 2200° F. to about 2500° F. (1205°-1370° C.).

By means of the present invention, the emission of nitrogen oxides is substantially reduced because of the elimination of the region in a conventional petroleum coke incinerator where both high temperatures and an abundance of excess oxygen exist. The actual amount of nitrogen oxide emissions from the system will vary dependent upon the nature of the green coke charge, the kiln operating conditions, the incinerator design, and other factors. In all cases, however, the formation of $NO_x$ will be less than in a conventional system.

The stoichiometric air requirement for complete combustion of the hydrocarbons (and any carbon monoxide) in the calciner effluent gas will, of course, depend upon the hydrocarbon content of the gas which, in turn, is dependent upon various factors such as the hydrocarbon content of the green coke, the charge rate of the green coke, the hydrocarbon composition, and the amounts of fuel gas and air injected into the kiln. Any suitable control means may be utilized for regulating the primary air injection through the nozzles 56 so as to avoid any substantial excess of oxygen over the stoichiometric requirement. For example, the control system may include means for measuring the $NO_x$ content or the unburned hydrocarbon content of the exit gas from the zone 52 and regulating the primary air injection accordingly. In many cases, effective control of the primary air injection can be obtained by continuously measuring the exit temperature of the gas from the staged combustion zone 52 and automatically controlling the injection of air to achieve a predetermined maximum temperature. For example, in a typical operation a maximum temperature of about 2950° F. (1620° C.) will be achieved using 100% of the stoichiometric air requirement. The amount of secondary combustion air injected through the nozzles 62 is preferably controlled by monitoring the oxygen content of the exhaust gas from the incinerator stack and regulating the injection of secondary air so as to obtain a desired level of excess oxygen in the stack gas. In general, the injection of secondary combustion air will be controlled to maintain an oxygen content between about 1% and about 10%, preferably between about 2% and about 5%.

Although only two primary air nozzles 56 and two secondary air nozzles 62 are shown in FIG. 2, it will be understood that the size, number, and arrangement of the air injection nozzles will be selected so as to insure good mixing between the hot process gas and the cold combustion air. Generally, the degree of mixing will increase with an increase in the number of nozzles and with a decrease in the diameter of the nozzles to achieve higher gas velocities.

Although the foregoing description of FIG. 2 pertains to a petroleum coke calcining process, the invention is also applicable in the case of anthracite coal calcination.

The following is a hypothetical operating example of the invention based on design calculations for a petroleum coke calciner installation like FIG. 2 having a capacity of 50 ton/hr. of green coke.

The temperature of the effluent gas stream from the kiln 10 is 1800° F. (980° C.), and the material inventory of this stream is shown in the following Table I:

TABLE I

| COMPONENT | LBS/HR | SCFM |
|---|---|---|
| Carbon Monoxide | 4,309 | 972 |
| Carbon Dioxide | 26,873 | 3,858 |
| Nitrogen | 127,520 | 28,768 |
| Oxygen | 0 | 0 |
| Sulfur Dioxide | 987 | 97 |
| Volatile Hydrocarbons | 7,489 | 7,883 |
| Moisture | 29,811 | 10,462 |
| Carbon Particulate | 7,014 | — |
| Ash | 28 | — |
| Total | 204,031 | 52,040 |

The stoichiometric amount of primary air is added through the nozzles 56 as required to burn all of the CO and volatile hydrocarbons in the kiln effluent gas to $CO_2$ and $H_2O$. The material inventory of the primary air stream is shown in the following Table II:

TABLE II

| COMPONENT | LBS/HR | SCFM |
|---|---|---|
| Oxygen | 30,421 | 6,005 |
| Nitrogen | 100,167 | 22,597 |
| Moisture | 566 | 199 |
| Total | 131,154 | 28,801 |

The gas velocity in the kiln is 3000 ft./min., and the gas velocity in the staged combustion zone must be greater than 3000 ft./min. to prevent drop-out of the entrained particulate carbon. The vessel 50 is designed so that the combustion zone 52 has an internal diameter of 13.3 ft., thereby providing a gas velocity of 3500 ft./min. The length of the zone 52 is 29.2 ft. so as to provide a residence time of 0.5 sec.

The effluent gas stream from the staged combustion zone 52 has a temperature of 2980° F. (1640° C.), and the material inventory of this stream is shown in the following Table III:

TABLE III

| COMPONENT | LBS/HR | SCFM |
|---|---|---|
| Carbon Dioxide | 55,611 | 7,984 |
| Nitrogen | 227,688 | 51,365 |
| Oxygen | 0 | 0 |
| Sulfur Dioxide | 985 | 97 |
| Moisture | 43,860 | 15,391 |
| Carbon Particulate | 7,014 | — |
| Ash | 28 | — |
| Total | 335,186 | 74,837 |

Secondary air is introduced through the nozzles 62 and mixed with the effluent gas from the staged combustion zone 52 in an amount sufficient to burn all of the particulate carbon to $CO_2$ and to provide 2% excess oxygen in the effluent gas from the incineration chamber 32. The material inventory of the secondary air stream is shown in the following Table IV:

TABLE IV

| COMPONENT | LBS/HR | SCFM |
|---|---|---|
| Oxygen | 29,158 | 5,756 |
| Nitrogen | 96,004 | 21,658 |
| Moisture | 542 | 190 |
| Total | 125,704 | 27,604 |

The effluent gas from the incinerator chamber 32 has a temperature of 2450° F. (1345° C.), and the material inventory of this stream is shown in the following Table V:

TABLE V

| COMPONENT | LBS/HR | SCFM |
|---|---|---|
| Carbon Dioxide | 81,431 | 11,690 |
| Nitrogen | 323,691 | 73,023 |
| Oxygen | 10,381 | 2,049 |
| Sulfur Dioxide | 985 | 97 |
| Moisture | 44,401 | 15,581 |
| Ash | 28 | — |
| Total | 460,917 | 102,440 |

The gas discharged from the incinerator stack will have an $NO_x$ content of about 120 ppm or less, as compared with the usual $NO_x$ level of about 300 ppm or more when using a prior art calcining and incineration system of the type illustrated in FIG. 1.

We claim:

1. In a process for calcining carbonaceous solids wherein a hot effluent gas stream containing hydrocarbon vapors and entrained carbonaceous solid particles is removed from a calciner and introduced into a thermal incinerator for combustion of said vapors and said particles, the improvement which comprises effecting preliminary combustion of the hydrocarbon vapors but not the carbonaceous solid particles in said gas stream using substantially the stoichiometric amount of combustion air, and introducing the resultant gas that is substantially free of hydrocarbons and oxygen into the thermal incinerator and therein effecting combustion of said carbonaceous solid particles with additional combustion air, whereby to reduce the nitrogen oxide emissions from the incinerator.

2. A method of incinerating hot effluent gas from a petroleum coke or anthracite coal calciner to remove volatile hydrocarbons and entrained carbonaceous solid or coke particles from the gas while at the same time minimizing the nitrogen oxide emissions during incineration, said method comprising the steps of mixing said gas in a first zone with substantially the stoichiometric requirement of air for a relatively short residence time sufficient to effect combustion of the volatile hydrocarbons but not the carbonaceous solid or coke particles, and thereafter mixing the gas with excess combustion air and introducing the mixture into a second zone for a relatively longer residence time sufficient to effect combustion of said particles.

3. A method of reducing nitrogen oxide emissions during thermal incineration of the hot effluent gas from a petroleum coke or anthracite coal calcination step, comprising passing said effluent gas containing hydrocarbon vapors and entrained carbonaceous solid or coke particles through a staged combustion zone having an inlet and an outlet, introducing combustion air into said zone adjacent said inlet in an amount sufficient to effect substantially complete oxidation of the hydrocarbon vapors in said gas but not in substantial excess of the required stoichiometric amount, mixing said combustion air with said gas in said zone and providing a restricted residence time for the mixture in said zone sufficient to effect substantially complete oxidation of said hydrocarbon vapors without effecting combustion of said particles, whereby the resultant gas is substantially free of hydrocarbon vapors and excess oxygen, mixing excess combustion air with said resultant gas and introducing the mixture into an incineration chamber, and providing sufficient residence time for the mixture in said incineration chamber to effect combustion of said particles, whereby to avoid in said incineration chamber the combination of high temperature, excess oxygen, and long residence time conducive to the formation of nitrogen oxide.

4. The method of claim 3 wherein the peak temperature in said staged combustion zone is from about 2600° F. to about 3000° F., and the peak temperature in said incineration chamber is from about 2200° F. to about 2500° F.

5. The method of claim 3 wherein the residence time in said staged combustion zone is from about 0.3 to about 0.7 seconds, and the residence time in said incineration chamber is at least about 12 seconds.

6. The method of claim 3 wherein the velocity of the gas in said staged combustion zone is sufficiently high to prevent settling of the entrained particles.

7. The method of claim 3 wherein said staged combustion zone is dimensioned to maintain a gas velocity therethrough sufficient to prevent settling of the entrained carbonaceous solid or coke particles and a residence time sufficient to effect preferential combustion of said hydrocarbon vapors but not said carbonaceous solid or coke particles.

8. In an apparatus for calcining carbonaceous solids comprising a calciner, a thermal incinerator, and a passage for passing hot calciner effluent gas containing hydrocarbon vapors and entrained carbonaceous solid particles from said calciner to said incinerator, the improvement wherein said passage comprises means defining a staged combustion zone having an inlet and an outlet and adapted to have the calciner effluent gas passed therethrough before entering the incinerator, means for introducing a controlled quantity of combustion air into said zone adjacent said inlet for effecting preferential combustion of said hydrocarbon vapors in said calciner effluent gas but not said carbonaceous solid particles, and means for mixing additional combustion air with the gas passing from said outlet into said incinerator for effecting combustion of said carbonaceous solid particles.

9. The apparatus of claim 8 wherein said means defining said staged combustion zone comprises an elongated tubular combustion vessel having an inlet end portion arranged to receive hot effluent gas from the calciner, an intermediate combustion zone portion, and an outlet end portion arranged to discharge gas into the incinerator, a plurality of nozzles mounted in said inlet end portion for injecting said controlled quantity of combustion air into said combustion zone portion, and a plurality of additional nozzles mounted in said outlet end portion for injecting said additional combustion air to be mixed with the gas passing from said outlet into the incinerator.

10. The apparatus of claim 8 wherein said staged combustion zone is dimensioned to maintain a gas velocity therethrough sufficient to prevent settling of the entrained carbonaceous solid particles and a residence time sufficient to effect preferential combustion of said hydrocarbon vapors but not said carbonaceous solid particles.

* * * * *